US005349843A

United States Patent [19]

Hubball

[11] Patent Number: 5,349,843

[45] Date of Patent: Sep. 27, 1994

[54] OVERHEAD BELT DISCHARGE APPARATUS FOR CONTAINER END CLOSURES

[75] Inventor: Martin M. Hubball, Arlington Hts., Ill.

[73] Assignee: Buhrke Industries, Inc., Arlington Heights, Ill.

[21] Appl. No.: 83,622

[22] Filed: Jun. 25, 1993

Related U.S. Application Data

[63] Continuation-in-part of Ser. No. 926,764, Aug. 6, 1992, abandoned.

[51] Int. Cl.[5] ..... B21D 45/02

[52] U.S. Cl. ..... 72/344; 72/361; 72/426

[58] Field of Search ..... 72/344, 345, 361, 426, 72/428; 198/725

[56] References Cited

U.S. PATENT DOCUMENTS

| | | | |
|---|---|---|---|
| Re. 33,061 | 9/1989 | Brown | 413/66 |
| 1,786,779 | 12/1930 | Quick | 198/725 |
| 2,275,561 | 3/1942 | Sahlin | 113/50 |
| 2,299,816 | 10/1942 | Goebel | 72/426 |
| 3,231,065 | 1/1966 | Kaminski et al. | 198/131 |
| 3,525,248 | 8/1970 | Schulte et al. | 72/361 |
| 3,812,953 | 5/1974 | Maschke | 198/131 |
| 4,072,156 | 2/1978 | Abe | 198/725 |
| 4,203,314 | 5/1980 | Vandlik et al. | 72/427 |
| 4,513,600 | 4/1985 | Grow et al. | 72/345 |
| 4,561,280 | 12/1985 | Bachmann et al. | 72/346 |
| 4,567,746 | 2/1986 | Bachmann et al. | 72/348 |
| 4,568,230 | 2/1986 | Brown | 413/66 |
| 4,599,884 | 7/1986 | Bachmann et al. | 72/346 |
| 4,627,264 | 12/1986 | Grow et al. | 72/345 |
| 4,696,179 | 9/1987 | Cook et al. | 72/405 |
| 4,770,022 | 9/1988 | Cook et al. | 72/361 |
| 4,854,799 | 8/1989 | Herdzina et al. | 413/66 |
| 4,860,569 | 8/1989 | Herdzina | 72/361 |
| 4,895,012 | 1/1990 | Cook et al. | 72/361 |
| 4,903,521 | 2/1990 | Bulso, Jr. et al. | 72/336 |
| 4,904,140 | 2/1990 | Herdzina et al. | 413/56 |
| 5,067,341 | 11/1991 | Wynn et al. | 72/344 |

*Primary Examiner*—Lowell A. Larson
*Attorney, Agent, or Firm*—Welsh & Katz, Ltd.

[57] ABSTRACT

An end discharge system is disclosed for quickly removing blanked and formed end closures from a forming press, the end discharge system including rotating overhead belts mounted closely adjacent the press tooling, and operable to receive air-blasted or otherwise-ejected pre-curled end closures from the forming tooling and then rapidly draw the discharged end underneath the belt along a guide track in a discharge plate away from the tooling area, for subsequent delivery to associated cross conveyors or other end collection equipment. The belt discharge apparatus allows the container ends to be quickly deposited in a uniform, consistently spaced line or pattern upon the associated cross conveyors, all without any substantial damage to the ends and any coated surfaces thereon.

33 Claims, 8 Drawing Sheets

Fig. 1
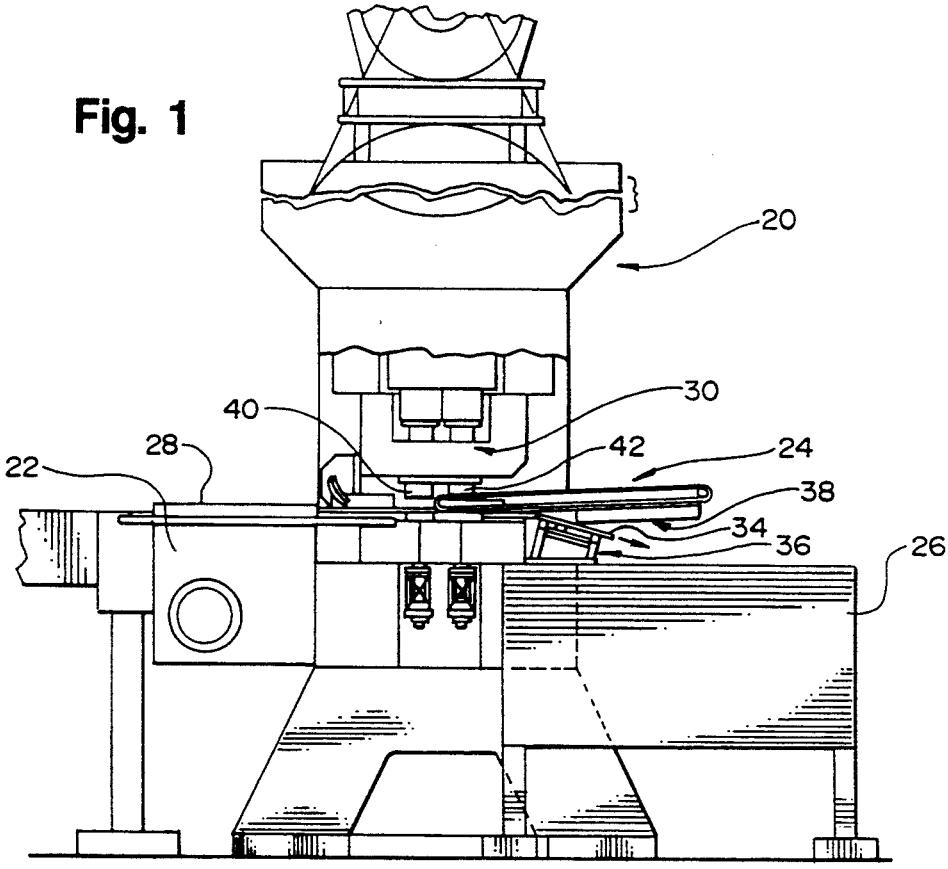
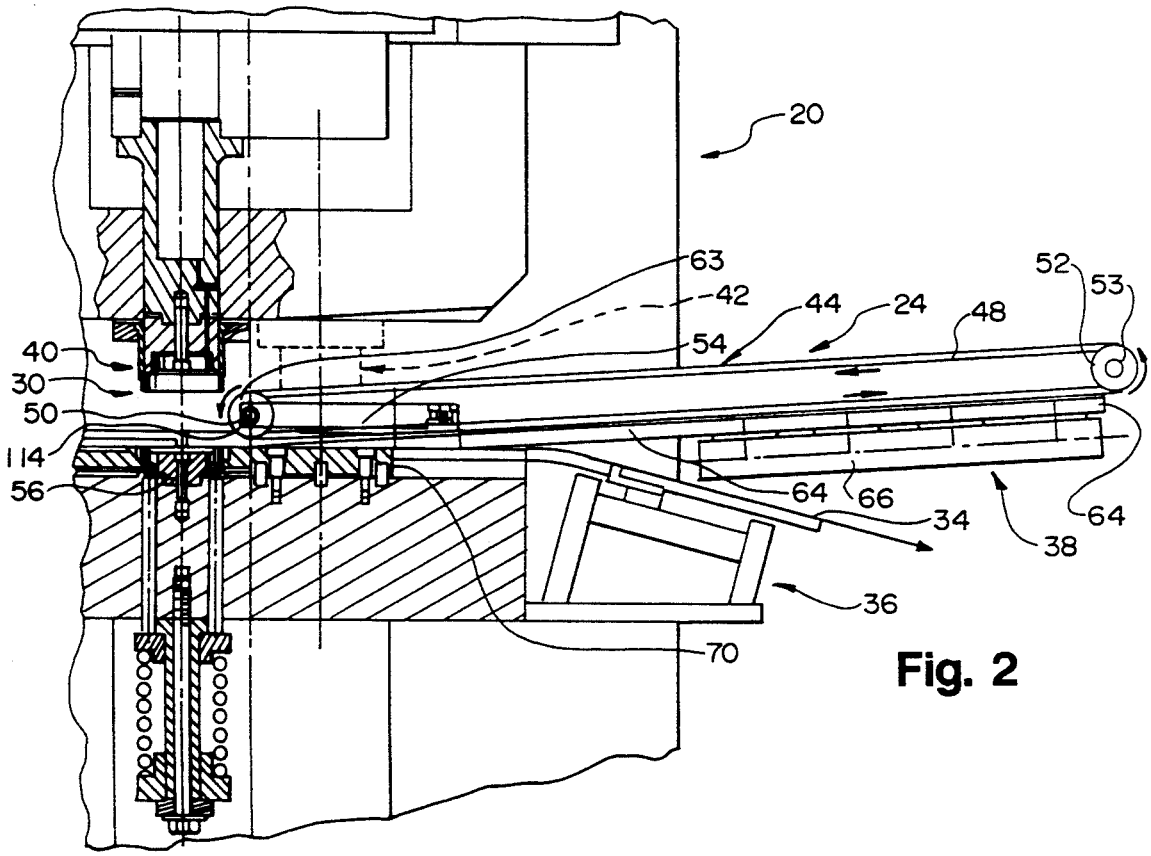
Fig. 2

OVERHEAD BELT DISCHARGE APPARATUS FOR CONTAINER END CLOSURES

FIELD OF THE INVENTION

This application is a continuation-in-part of application Ser. No. 926,764, filed Aug. 6, 1992, now abandoned.

This invention relates to end discharge machines used for removing blanked and formed container end closures from forming press tooling.

BACKGROUND OF THE INVENTION

Can ends, or so-called end closures, such as used for food and beverage cans, are typically formed in blanking and forming presses, such as mechanical dual action slide presses. However, press speeds are often limited by the ability to quickly remove the resultant blanked and formed ends, i.e., to make sure there is no interference by a formed end with the entry of sheet stock into the press tooling during the next press cycle.

Known prior art methods for discharging blanked and formed ends from a press include operating the press at an angle, such as at 45 degrees to the horizontal, to allow gravity discharge of formed ends. However, because such presses had to pull and return the die set on an angle, overall operational speeds of such presses were substantially reduced. Further, that method does not assure that the ends will be discharged simultaneously, or that they will remain in proper alignment and orientation relative to any associated conveyor belt, for example, as may be used to deliver such ends to following operations or to packaging equipment.

An additional known method of discharging formed ends includes using an air-blast to blow the ends from the press tooling onto associated conveyors. However, because of constraints on physically housing a conveyor next to an operating press, the conveyors are typically as much as two to three feet away. Thus, by the time a series of air-blasted end closure leaves the tooling and reaches the associated conveyor over such a distance, they drop onto it at staggered times, as some are under friction while others are slightly airborne. When so deposited on the conveyors, such air-discharged ends can be too close together, too far apart, or even stacked one upon another. This haphazard alignment renders them generally unusable for further operations, as such staggered or stacked alignment can cause jammed machinery during successive operations.

The present invention overcomes the prior art discharge methods and machinery, including the uneven spacing problems attendant therewith, by providing an overhead belt discharge apparatus mounted closely adjacent the press tooling. Such an overhead belt discharge apparatus is able to quickly collect and discharge blanked and formed end closures along guide tracks formed in a discharge plate to a discharge opening and to the awaiting cross conveyors or other discharge line equipment, all in a consistently-oriented and uniformly-spaced manner. Thus, the instant the blanked and formed shell end contacts the overhead discharge belt it is transported away to an associated cross conveyor, and then on to any following procedures, such as to can end edge curling machinery, for example. The speed of the overhead discharge belts can be adjusted, as needed, and can be pre-set to accommodate any given press speed. Further, due to the high operational speeds achievable with the present end discharge apparatus, the speed of the associated press can be substantially increased, thereby resulting in overall improved efficiency and operational speeds for the entire can end or so-called shell making operation.

With the present invention, the associated stamping press does not have to be mounted at an angle, since no gravity discharge is required for the formed ends. Instead, an upright press can be used which is easier to load and also easier to allow access to the die set and tooling for maintenance purposes. Further, an upright press reduces wear on the press tooling's leader pins, since there is no side load placed thereon such as occurs when operating a press on an angle like with the prior art discharge systems.

Although the present invention is most advantageously used with upright presses, the invention is not so limited and it can be employed with presses that are mounted at an angle. This can be especially advantageous when applying the present invention to the older-type presses that have the stamping station mounted at an angle.

The rotating discharge belts used with the present overhead discharge systems are sufficiently soft to allow each belt to readily grab and then draw the discharged end thereunder along the associated discharge tracks. Thus, there is no abrasion problem occurring to the coated side of the discharged end when it is in contact with the discharge belt. Instead, the so-called "public" i.e., uncoated side is the only part that slides on the discharge track, and then it is moved along a relatively non-abrasive surface. Further, since the present end discharge apparatus is located on the opposite side of the press from the infeeding sheet stock, it is easier to clear misfeeds and jams in the press tooling than when the sheet stock feed and end ejection equipment are on the same side of the press.

Thus, it is an object of the present invention to provide an overhead belt discharge apparatus for forming presses for container end closures which in a controlled manner rapidly and accurately discharges the ends to associated conveyor belts.

It is a further object of the present invention to provide end discharge apparatus which allows for vertical operation of the associated forming press and tooling.

It is yet a further object of the present invention to provide an overhead belt discharge system which utilizes air-blasts to quickly remove blanked and formed container ends from the die tooling to the awaiting rotating discharge belts, so as to provide rapid discharge of ends from the die tooling, thereby allowing increased operational speeds for the press and tooling.

The means by which the foregoing and other objects of the present invention are accomplished and the manner of their accomplishment will be readily understood from the following specification upon reference to the accompanying drawings, in which:

FIG. 1 is a side elevation environmental view of the end discharge apparatus of the present invention, shown in conjunction with associated sheet feed equipment, forming press, die tooling, and sheet stock discharge equipment;

FIG. 2 is an enlarged side elevation view of the end discharge apparatus of FIG. 1, showing the associated discharge belts, conveyors, and related components, and with certain of the die tooling removed for better viewing;

Figure 13:
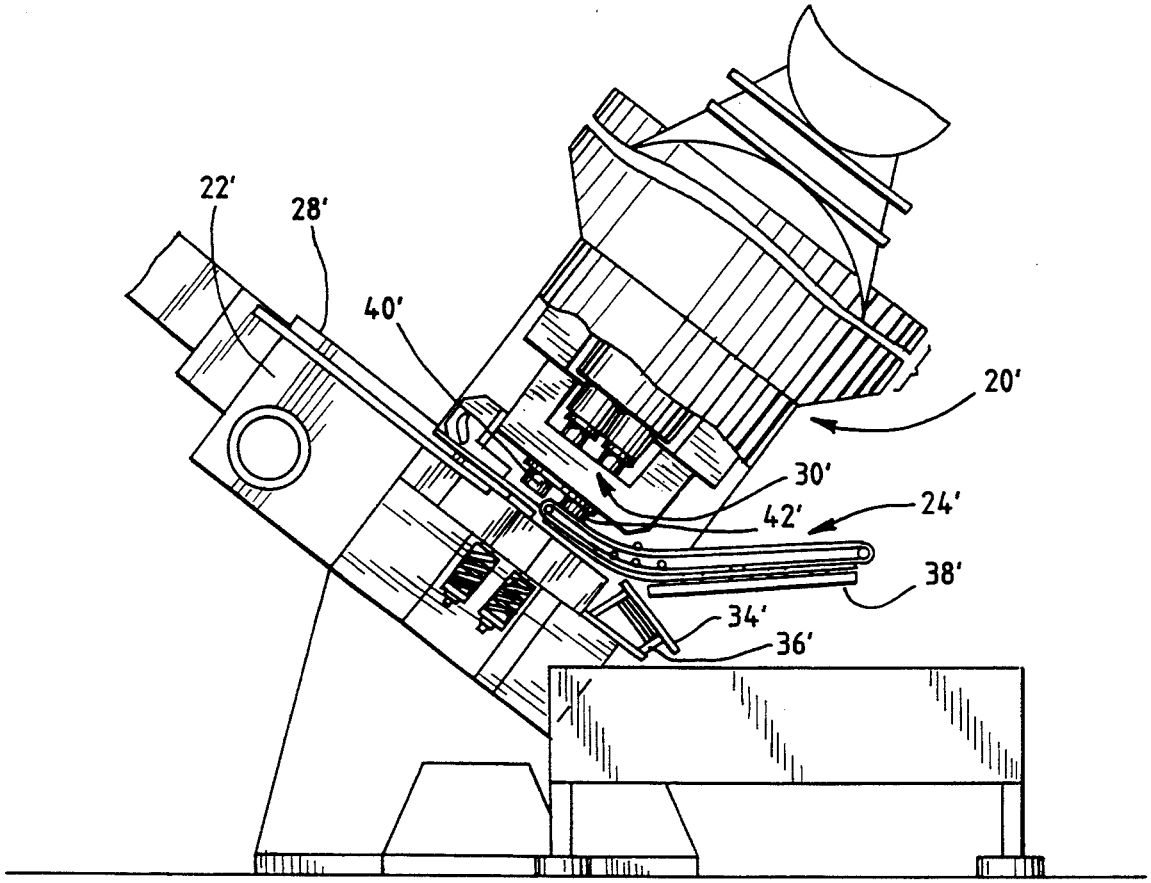
Figure 14:
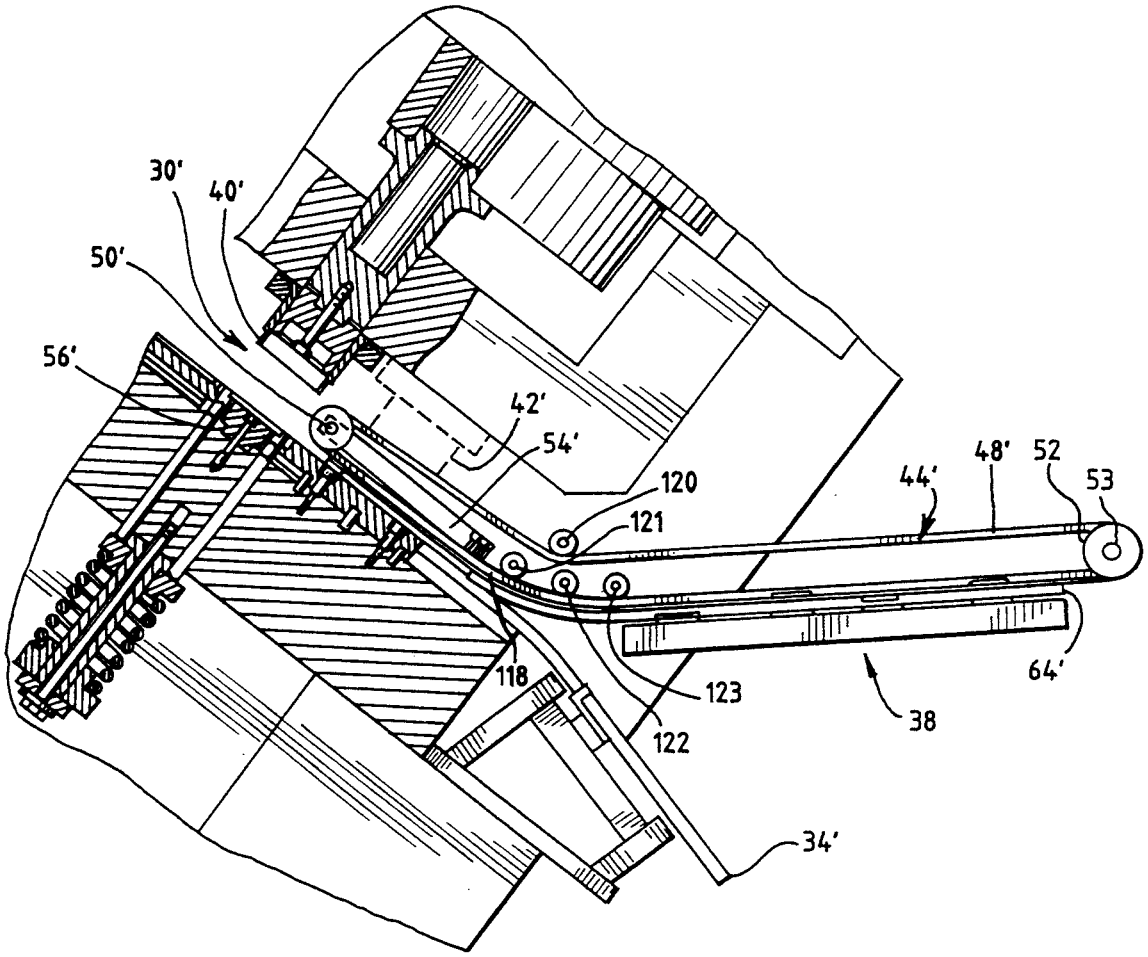

FIG. 13 is a side elevation environmental view of the end discharge apparatus of the present invention, shown in conjunction with associated sheet feed equipment, an angled forming press, die tooling, and sheet stock discharge equipment; and FIG. 14 is an enlarged side elevation view of the end discharge apparatus of FIG. 13, showing the associated discharge belts, conveyors, and related components, and with certain of the die tooling removed for better viewing.

DESCRIPTION OF THE PREFERRED EMBODIMENT

In reference to the drawings, wherein like reference numerals indicate corresponding elements, there is shown in FIG. 1 an illustration, in block diagram format, of a double action-type press 20, a sheet stock feeder mechanism 22, the improved belt discharge apparatus of the present invention, generally denoted by reference numeral 24, and an edge curler station 26. The incoming sheet stock 28 is fed from left to right (in FIG. 1) by the feeder 22 into the die tooling, generally denoted by reference numeral 30, which is mounted centrally of press 20. The double action press 20 and tooling 30 operate, in a well known fashion, to form a can end or so-called pre-curled shell which is generally denoted by reference numeral 32. The scrap sheet or perforated sheet stock 34, from which the shells or can ends 32 have been blanked and formed in the press 20, is removed by the sheet ejector mechanism 36. Further, the formed ends 32 are rapidly discharged by the improved belt discharge apparatus 24 of the present invention onto the transverse or so-called cross conveyors, generally denoted by reference numeral 38, which in turn feed the ends 32 into the curler station 26 or some other following operational or packaging procedure.

It will be understood that the present belt discharge apparatus 24 can be advantageously used with any appropriate type sheet feeder mechanism 22 and also with any suitable (vertical or otherwise) press 20.

Turning to FIG. 2, there is seen an enlarged view of the press tooling 30, as well as the various end discharge components of the present invention. Shown there are two rows of press tooling or die sets, namely, a rear series of die sets 40 and front series of die sets 42 (shown there in phantom). In one press configuration made in accordance with the present invention, each series or row of the respective rear and front die sets 40, 42 comprised five individual dies. Thus, with one stroke of the press 20, ten can ends 32 were blanked and formed, namely five ends 32 formed by the rear series of die sets 40, and five ends formed by the front series of die sets 42.

The present improved belt discharge apparatus 24 includes (see FIGS. 2–4) a series of rear discharge belt assemblies 44 as associated with the respective rear die sets 40, and a series of front discharge belt assemblies 46 as associated with the front die sets. The discharge belt assemblies 46 are mounted on a relatively wide discharge plate 64. Each of the rear and front discharge belt assemblies 44, 46 comprises a rotating discharge belt 48 running the length of the discharge plate 64, a nose pulley 50, a rear drive pulley 52, and an articulated tension arm 54 for supporting the nose pulley 50 and rotating belt 48 closely adjacent the respective die sets 40, 42. The tension arm 54 is pivotally mounted about a pivot pin 55 (see FIGS. 3 and 4) and is preferably spring-urged (to the left in those FIGURES) so as to maintain tension on each rotating discharge belt 48. Additionally, as seen in phantom in FIG. 4, the articulated tension arm 54 can be pivoted about pin 55 as needed, i.e., raised to an elevated position, whereby the nose pulley 50 and discharge belt 48 are raised upwardly away from the lower die shoe 56. In that condition, the respective die sets 40, 42 can be easily cleared of any jams or otherwise accessed for maintenance.

As seen in FIGS. 2–4 and 6–8, the respective nose pulleys 50 and discharge belts 48, of the respective rear and front discharge belt assemblies 44, 46, are positioned as close as possible to the respective rear and front die sets 40, 42. This close positioning of the discharge belt assemblies relative to the die tooling permits the blanked and formed can ends 32, once ejected from the respective die sets 40, 42, to be quickly grabbed and discharged away from the press area, along guide tracks formed in the discharge plate 64, as explained in more detail later herein.

Figure 6:
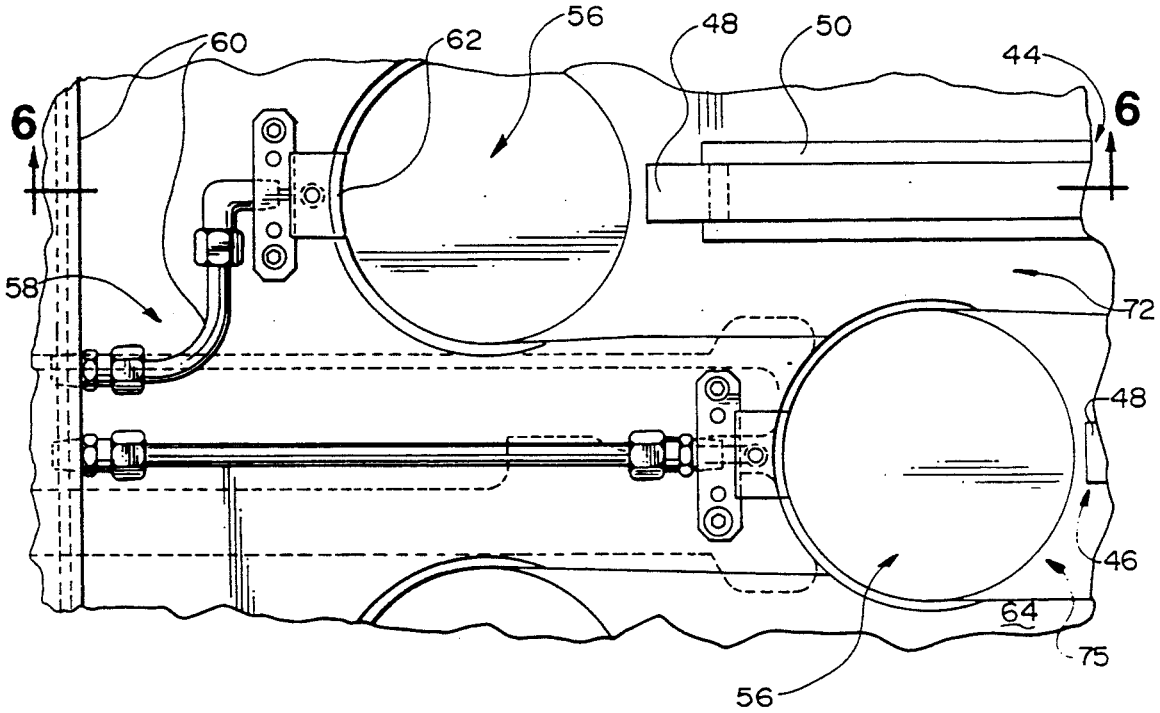
FIG. 6 is a top plan view of a portion of the lower press die tooling, discharge belts, and air ejection components.
Figure 7:
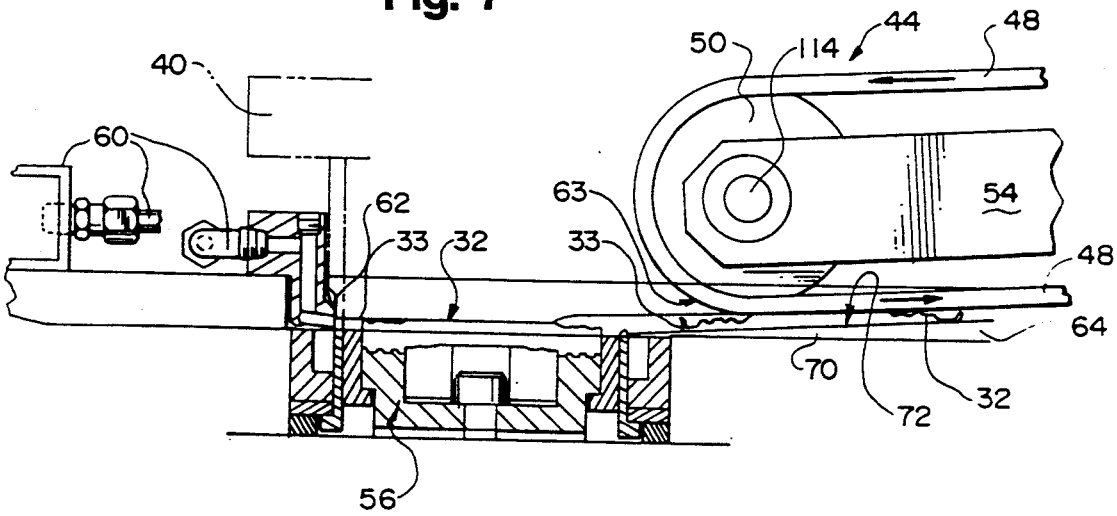
FIG. 7 is an enlarged side elevation view of the lower die tooling, belt and discharge ramp components, and depicting the discharge of an end.

As seen in FIGS. 6 and 7, an air ejection system 58, comprising air supply tubing 60 and an air ejector port 62, are used to supply a stream or timed blast of air against each blanked and formed can end 32. Thus, once the die tooling 30 opens (as shown in FIG. 7), an air blast from air ejector port 58 against the partial curled edge 33 of the can end 32 causes the same to be ejected up away from the lower die shoe 56 and moved to the right (see FIG. 7). There, the end 32 is engaged with, i.e., grabbed and trapped under, the lower rotating edge 63 of discharge belt 48 as it rotates around nose pulley 64. The belt 48 and pulley 50 move in the direction of the arrows (counterclockwise in FIGS. 3, 4, and 7). To be able to quickly and accurately grab and trap air-ejected end 32, yet be sufficiently wear-resistant, the belts 48 must be relatively soft, non-marking, and having a high coefficient of friction. One preferred material for the belt 48 is a urethane belting material having a shore hardness of 83A and sold commercially under the Eagle trademark. Such a soft belt material assures there is no substantial abrasion problem when contacting the can ends 32, which often are pre-treated with a surface coating. The respective discharge belts 48 in the preferred embodiment are of two basic lengths, namely, a longer belt 48 for use with the rear discharge belt assemblies 44, and a shorter belt 48 for the front discharge belt assemblies. This occurs since all the rear drive pulleys 52 (as described later herein) operate off the same drive shaft 53.

The discharge plate 64 is mounted upon a frame assembly 66 and so positioned relative to the press base 68 that its leading beveled edge 70 lies closely adjacent the lower die shoes 56 of the respective rear and front die sets 40, 42. A series of longitudinal guide tracks or discharge ramps are formed in the discharge plate 64 such that one track is aligned and operable with each respective discharge belt assembly 44, 46. With respect to each of the rear discharge belt assemblies 44, an inclined guide track 72 is machined or otherwise formed into the discharge plate 64, and has generally a shallow, rectangular cross-section (see FIGS. 5 and 10). The lower or driven segment of the rotating discharge belt 48, operating as part of each rear discharge belt assembly 44, rides within the inclined guide track 72.

Similarly, for each of the front discharge belt assemblies 46 (see FIGS. 5 and 10), a configured guide track 74 is formed in discharge plate 64, but at a lesser angle or no angle relative to plate 64 versus the angle used to form guide tracks 72. Each guide track 74 has a generally T-shaped configuration which permits outer peripheral areas of the can ends 32 to be retained under the undercut side portions 76 of each track 74. Thus, as the ends 32 are being drawn along each track 74 by the lower driven stretch of discharge belt 48, the edges of end 32 ride in the undercuts 76.

An appropriately placed through hole or discharge opening 78 is formed through discharge plate 64 along the general mid-portion of each guide track 72, while similarly-placed discharge openings 80 are formed through discharge plate 64 and aligned with the respective guide tracks 74. The vertical side walls 82 of the guide tracks 72 (see plan view in FIG. 8) are relatively wide at their lefthand portion(of FIG. 8), and then merge together to form an arcuate back wall segment 84 over the discharge opening 78. Similarly, the undercut side wall 76 of the guide track 74 terminates over the discharge openings 80 in an arcuate back wall 86.

Figure 3:
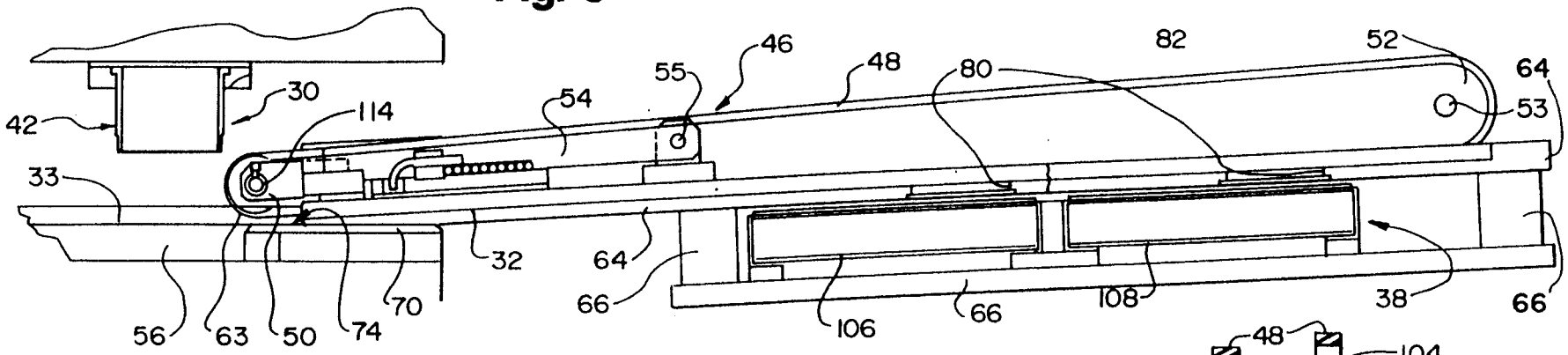
FIG. 3 is a further enlarged side elevation view of one series of the discharge belts of the present invention.
Figure 5:
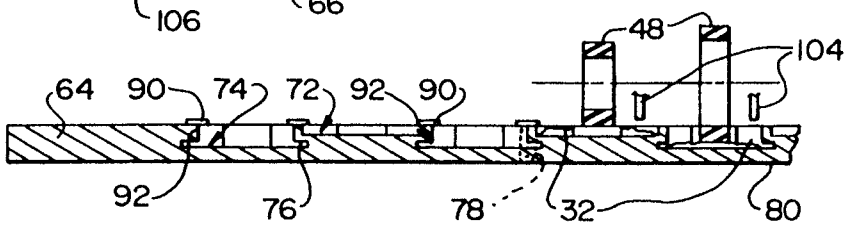
FIG. 5 is a partial sectional view, taken along lines 5—5 in FIG. 8 of the belt components and showing certain air ejector apparatus.
Figure 8:
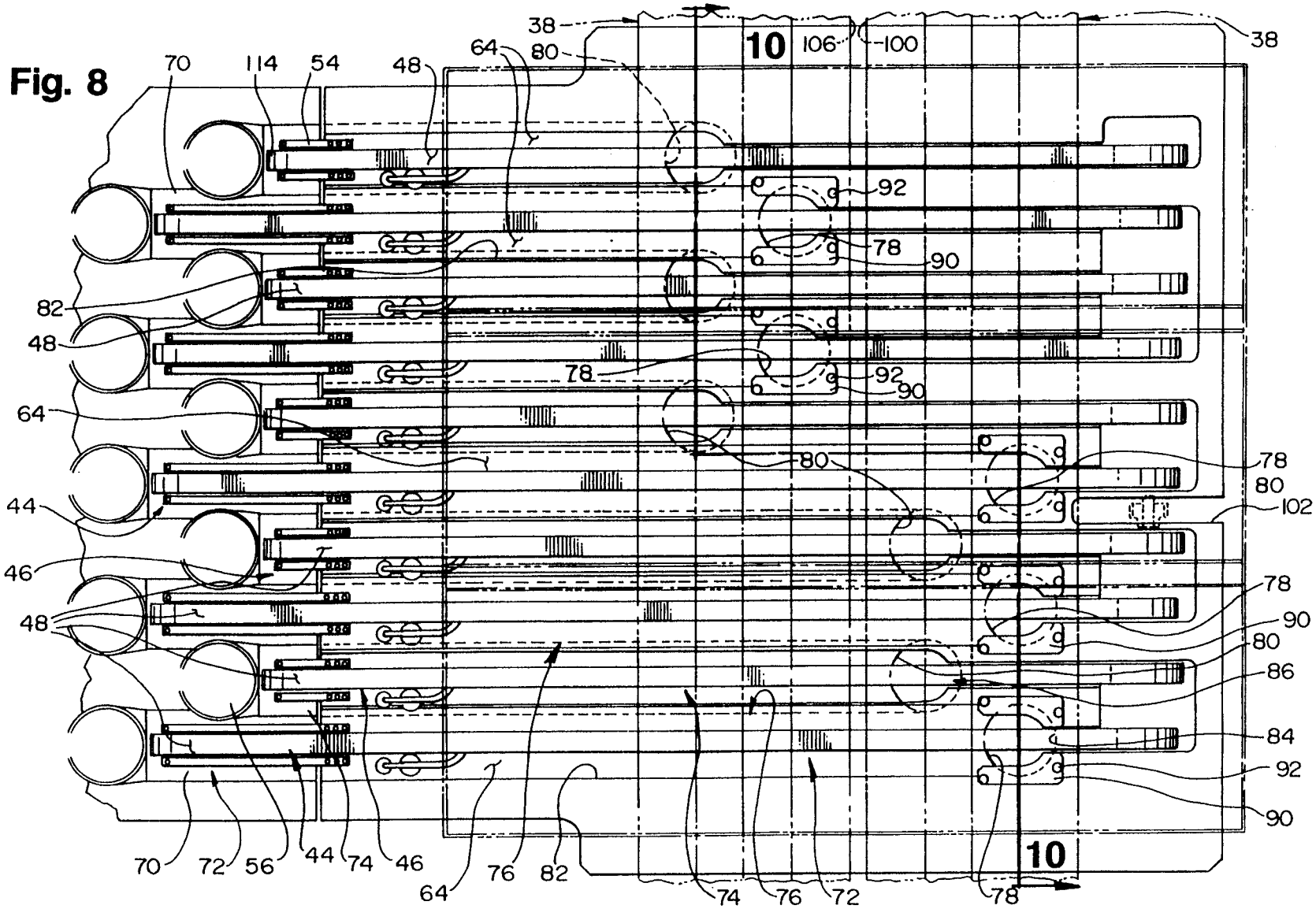
FIG. 8 is a top plan view of the discharge plate and the two series of discharge belts.
Figure 10:
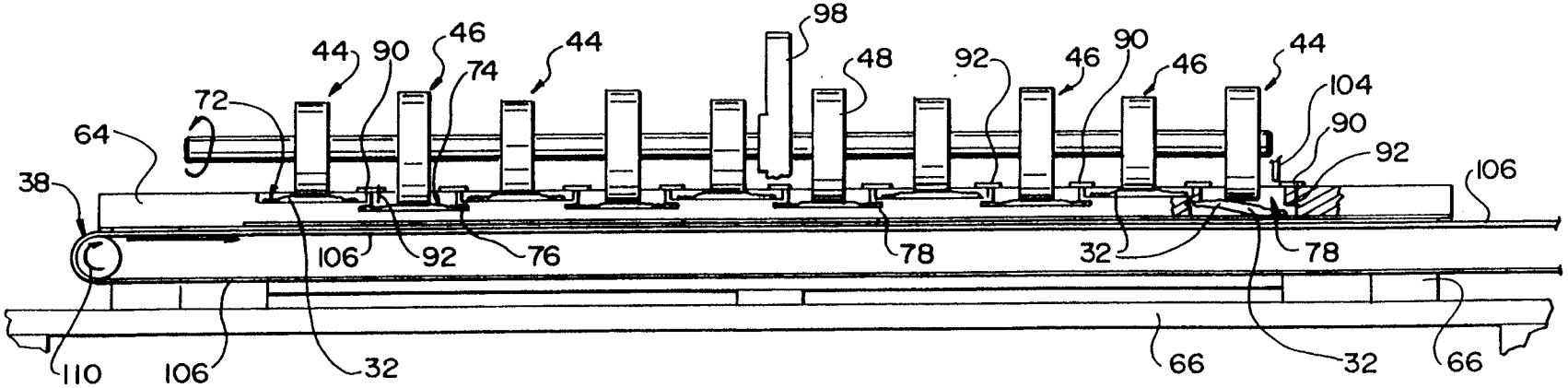
FIG. 10 is a rear elevation view, partly in section as viewed along lines 10—10 of FIG. 8, to show the discharge tracks and also depicting the typical drop discharge of an end onto a cross conveyor component.
Figure 11:
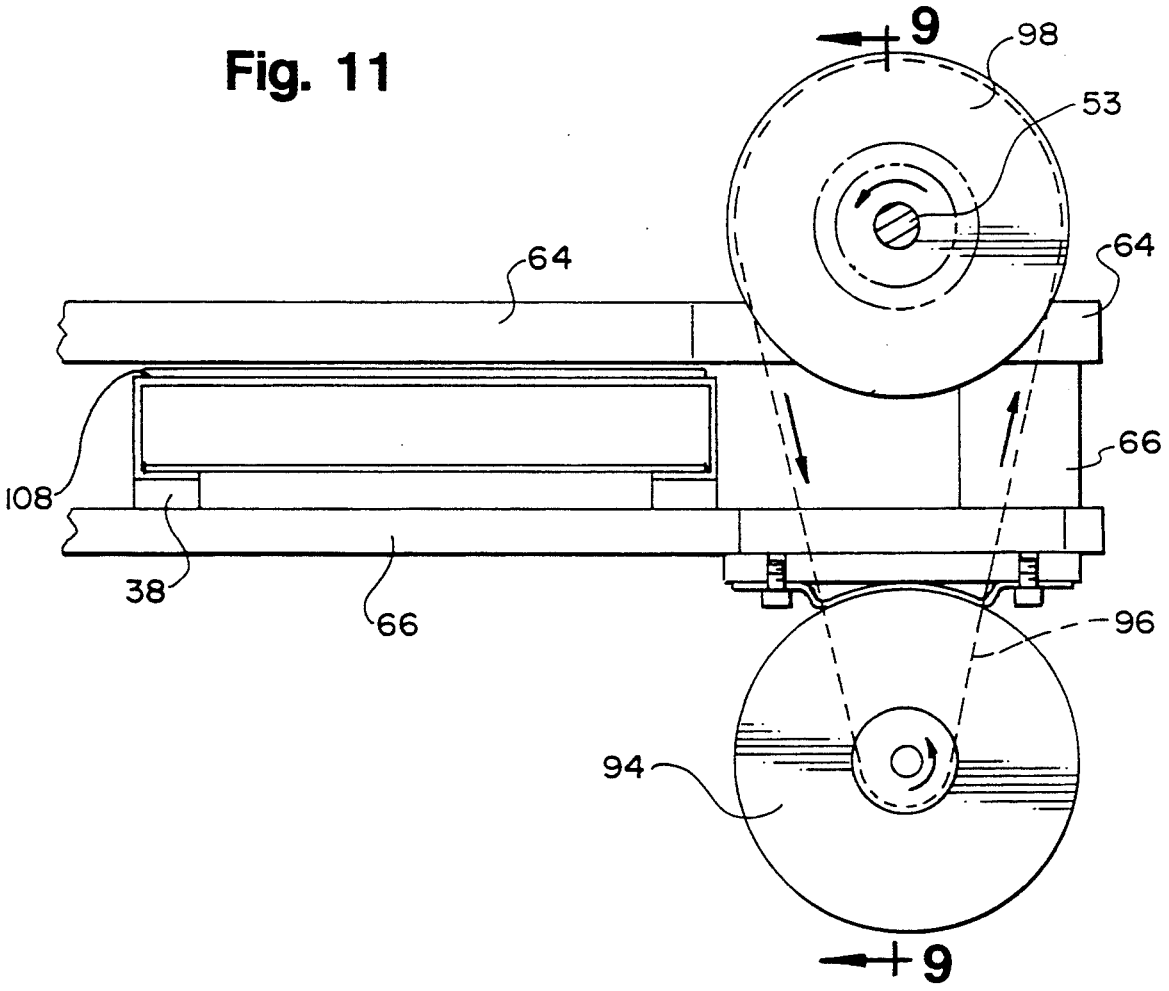
FIG. 11 is a side elevation view of the drive motor, discharge belts, jack shaft and related pulley drive equipment of FIG. 9.

As seen in FIGS. 5, 8, and 10, the upper or inclined guide tracks 72 overlay the lower guide tracks 74, so that the same are not in interference with one another, as they discharge the two different rows of ends formed by tooling sets 40, 42, in press 20. Further, comparing FIG. 3 with FIG. 4, the rear discharge belt assembly 44 of (FIG. 4) is shown as operating at a slightly higher incline or angle relative to the discharge plate 64, than is the front discharge belt assembly 46 of (FIG. 3). Thus, by having the two respective sets of guide tracks 72, 74 overlaid one over the other, i.e., with each guide track 74 being at a raised angle in plate 64 relative to each track 74, plate 64 can be kept to a minimal thickness. Further, since the leading beveled edge 70 of plate 64 can be made relatively thin, the nose pulleys 50 and rotating discharge belts 48 are allowed to be positioned as close as possible to their respective die sets 40, 42, all so as to quickly grab and discharge can ends 32.

A series of stopper plate members 90 (see FIGS. 5, 8, and 10) are fastened, such as by threaded fasteners 92, to the discharge plate 64 over the terminal end of each inclined guide track 72, adjacent the discharge opening 78 thereof. The purpose of stopper plates 90 is, similar to that of the undercuts 76 on guide tracks 74, to permit ends 32 being discharged along inclined guide track 72 from bouncing upwardly, at that location, and instead, to be discharged only downwardly through the discharge opening 78.

Figure 9:
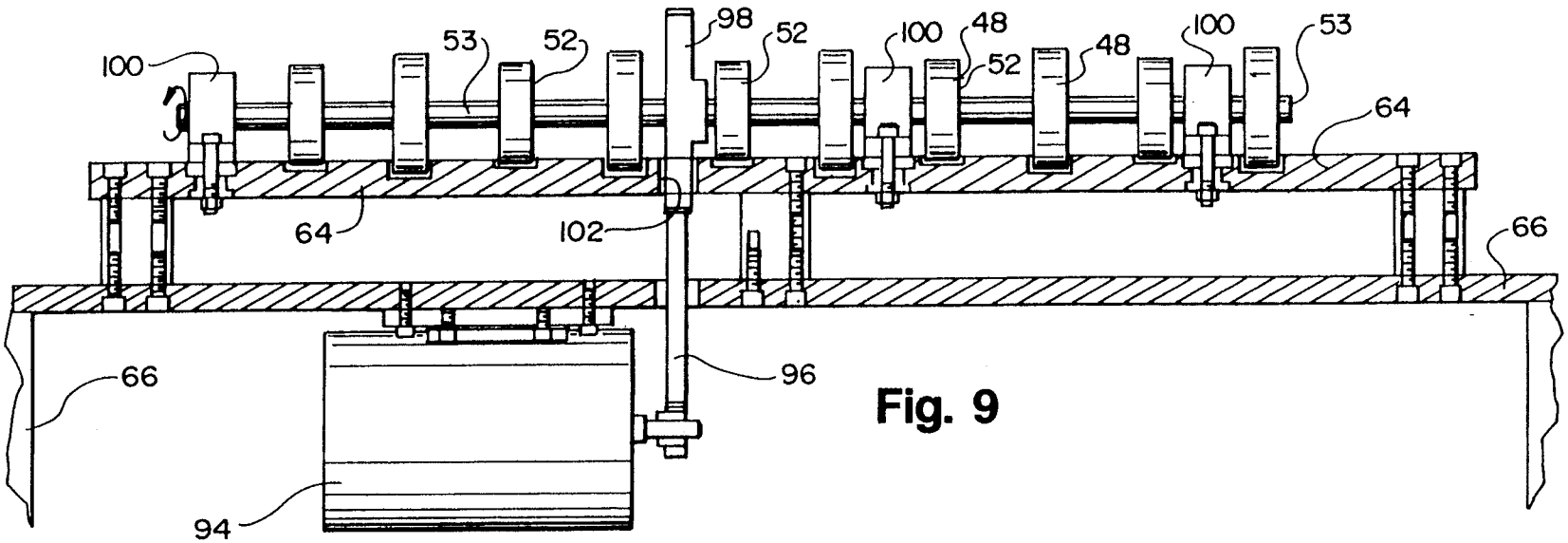
FIG. 9 is a rear elevation view of the discharge belt apparatus, looking from right to left in FIG. 8, and depicting certain drive components.

FIG. 9 depicts the various drive components utilized to drive the discharge belt assemblies 44, 46. They include a motor 94 mounted to the frame assembly 66, which through a ribbed drive belt 96 drives a drive gear 98; that gear 98 is rigidly secured to, and thus rotatably drives, the drive shaft 53 which in turn drives all the rear drive pulleys 52 which are secured thereto. The drive shaft 53 is mounted for rotation in bearings 100 which are supported on discharge plate 64. As seen in FIGS. 8 and 9, the drive gear 98 operates within a slotted opening 102 formed through the rear end of discharge plate 64.

An air supply port 104 (see FIGS. 5 and 10) is mounted adjacent one side of each of the discharge openings 78 and 80; port 104 can be supplied with pressurized air from the same supply (not shown) used for air ejection system 58. The air supply port 104 is used (as described later herein) to supply a stream or blast of air against one transverse edge portion of each can end 32 as the same is being discharged through the respective discharge openings 78, 80.

Figure 4:
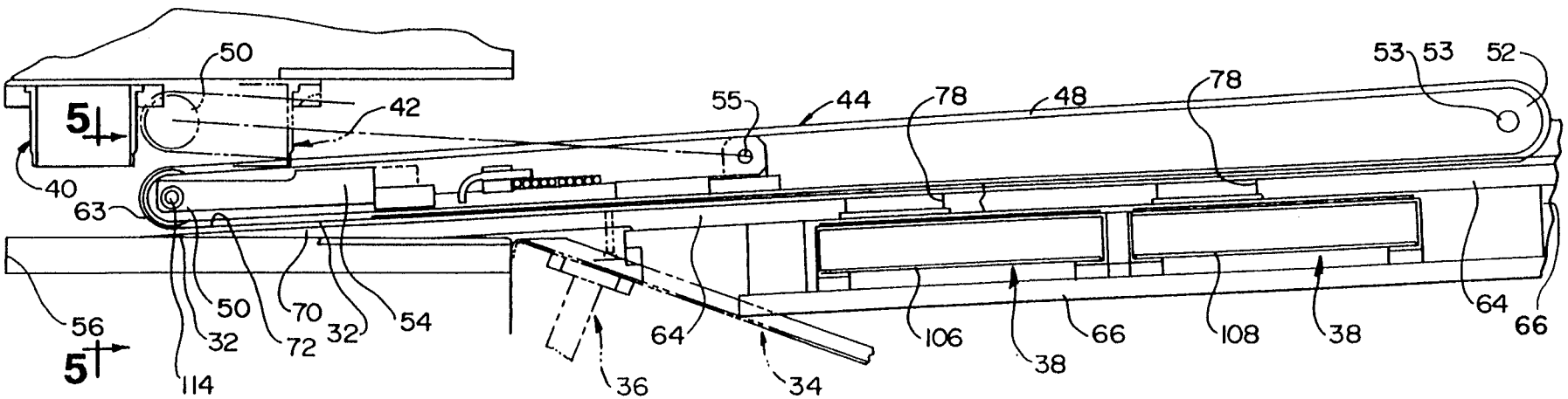
FIG. 4 is another enlarged side elevation view, similar to FIG. 3, but of the other series of discharge belts.

Shown in FIGS. 2–4, and 8, 10, and 11, is the cross conveyor apparatus 38. As best seen in FIGS. 3, 4, and 8, the cross conveyors generally comprise two conveyor belt assemblies, namely a rear belt 106 and a front belt 108, operating on conveyor drive rollers 110 supported on frame 66. When the can ends 32 are made of a ferrous-type metal, such as galvanized steel, for example, the conveyor belts 106, 108 can be magnetized. However, if the can ends 32 are made of an aluminum alloy, for example, the cross conveyors 38 can be vacuum-type conveyors. The rear and front conveyor belts 106, 108 preferably move in the same direction (of the directional arrows depicted in FIGS. 8 and 10). Belts 106, 108 are used to receive the can ends 32 being discharged through the respective discharge openings 78, 80. As seen in FIG. 8, cross conveyor belt 106 receives discharged can ends 32 from the uppermost group of five discharge belt assemblies 44, 46, while cross conveyor 108 receives ends 32 being discharged from the lowermost group of five discharge belt assemblies 44, 46. By using two cross conveyors 38, i.e., namely rear and front conveyor belts 106, 108, such conveyors can be driven at substantially slower speeds than if only one such conveyor belt were used. Thus, there need be no reduction in the high operational speeds and output levels achievable by the press 20, in view of the high operational speeds provided for by the present improved belt discharge apparatus 24. That is, preferably at least two cross conveyors 106, 108 are used, each receiving one-half of the ends 32 produced per cycle of press 20, such that the cross conveyors 106, 108 can each operate at slower speeds (versus the high-speed operation of press 20). This allows the conveyors 106, 108 to accurately feed the discharged ends 32 on to the next shell-making operation, such as an edge curling machine, or to a packaging collection point.

Figure 12:
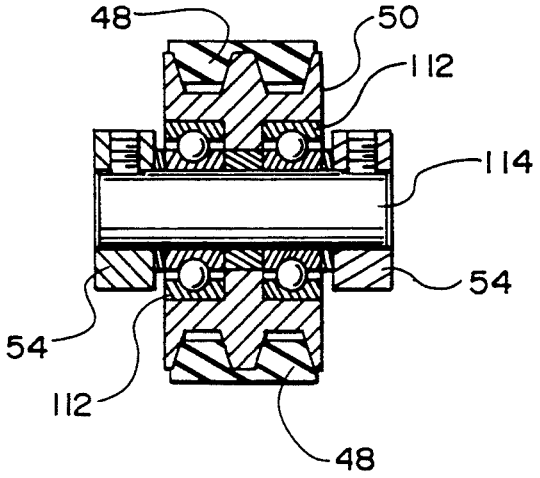
FIG. 12 is an enlarged section through a typical nose pulley component for a discharge belt of the present invention.

FIG. 12 depicts the nose pulley 50 mounted through bearings 112 on a pulley shaft 114 carried by the tension arms 54 for each rear and front discharge belt assemblies 44, 46.

I turn now to the operation of the improved belt discharge apparatus 24 of the present invention. It will be understood that the dual action press 20 operates in a well-known manner to form pre-curled can ends or shells 32 in the rear and front die sets 40, 42. Upon opening of press 20, the can ends 32 are air-ejected off the lower die shoe 56, in each die set 40, 42, by the air ejection system 58, providing a blast of air from air ejection hole 62. This blast of air (see FIGS. 6 and 7) directed against the outer curl edge 33 of each can end 32 causes the same to be moved to the right (in FIG. 7) by approximately the length of only one can end, whereupon the end 32 is grabbed by the lower nose area 63 of rotating discharge belt 48. The can end 32 is then quickly drawn (to the right) under the lower stretch of belt 48 along the associated guide track 72, 74, until the can end 32 strikes against the respective back wall 84, 86. At that instance, the end receives an air blast from the air supply port 104, whereupon the end 32 drops through the respective discharge openings 78, 80 onto the respective cross conveyor belt 106, 108. More specifically, the air blast from the air supply port 104 is directed against the right edge (see FIG. 10) of can end 32, as that end hits the back wall 86 of track 72 and starts to drop through discharge opening 78. This allows the right side portion of can end 32 to be the first portion to hit the conveyor belt 106 as the latter moves to the right, rotates counterclockwise in accordance with the directional arrows in FIG. 10. In this manner, the can ends 32 so discharged onto conveyor belt 106 are, in effect, laid onto magnetized belt 106, rather than tending to flip over, such as might occur if the trailing edge, the left edge of can end 32 in FIG. 10, were instead the first portion to contact the belt 106. Also, it will be understood that the cross conveyors 106 and 108 can run in the same direction, as in the preferred embodiment, or in opposite directions, depending upon downstream can-making application needs. Thereafter, the discharged can ends 32 are quickly moved, since they are now in proper orientation, alignment, and spacing, by the cross conveyor belts 106 and 108, to the next operational station. That could be either a cutler station 26, for example, where a final curl configuration could be formed on each can end 32, or to some other station, such as for packaging. Thus, it is seen that the present invention provides uniform and consistent placement, with correct alignment and spacing, of the discharge ends 32 onto the cross conveyor belts 106, 108.

It will be understood that, instead of using the air ejection system 58, having air supply tubing 60 and air ejection port 62, a mechanical device could be used to forcibly eject the formed ends 32 out of the lower die tooling 56 and towards and underneath the lower nose area 63 of each rotating discharge belt 48. For example, a cam-actuated series of timed ejector fingers could be used to kick out the ends 32 from the die sets 40, 42, once the press 20 opens. However, such a mechanical-type ejection system, rather than the preferred embodiment's air-ejection system 58, has the risk of damaging the expensive die tooling 40, 42.

With the improved end discharge apparatus of the present invention, the respective discharge belts 48 picks up the ends 32 within one length of such an end, and then grabs and whisks it away along the respective guide track 72, 74. Thus, the only distance that each can end 32 is blown by the air ejection system 58 is one length of a can end. After that, they are quickly grabbed and removed under control within guide tracks 72, 74, by the rapidly rotating discharge belts 48.

The use of timed air blasts from air ejection ports 62 cause all such air-blown ends 32 to hit their respective discharge belts 48 at substantially the same time, i.e., within tenths of a second of one another. Thus, this assures that there is uniform discharge of the ends 32 which is quite advantageous for any subsequent packaging, or ancillary equipment, such as an edge curling unit. Further, it will be understood that all the discharge belts 48 are preferably run off a common drive shaft 53, but that they must discharge ends 32 over different running lengths, shorter guide tracks 74 and longer tracks 72. Thus, the operating diameter of the respective rear drive pulleys 52 for the rear and front discharge belt assemblies 44, 46 are different, i.e., different speeds are produced for the belts 48 (of respective assemblies 44, 46) which is needed so that all the ends 32 are discharged uniformly and at substantially the same time onto the respective cross conveyors 106, 108.

In one apparatus made in accordance with the present invention, a spacing of approximately 14 inches was maintained for the respective ends 32 being discharged down the respective guide tracks 72, 74. This assured no overlapping of one end 32 onto another on the respective conveyor belts 106, 108. The operational speed of the press 20 was run at approximately 150–200 press cycles per minute. The respective discharge belts 48 were then running at between 175 to 350 feet per minute. Such a high operational speed achievable with the present improved end discharge system of the present invention allows forming presses to operate twice as fast as any known prior art discharge systems would allow. Advantageously, the discharge belts 48 rotate continuously, there is no timed movement of such belts. Further, the cross conveyor belts 106, 108 preferably move continuously.

In the embodiment shown in the attached drawings, the press 20 blanks and forms ten can ends 32 at once, such that the same need to be quickly ejected in two separate rows. With the present invention, the front five can ends 32 (see FIG. 8) are drawn back along tracks 72 by the rear discharge belt assemblies 44 and at a high angle, while the other five can ends 32 are pulled back along track 74 at a low angle within plate 64. Nevertheless, due to the different operational speeds of the discharge belts 48 (of respective assemblies 44,46) as noted above, all ten can ends 32 consistently drop onto the discharge conveyor belts 106, 108 at substantially the same time and in a given line or pattern, depending upon the arrangements of discharge openings 78, 80.

FIGS. 13 and 14 depict an alternate embodiment of the present invention wherein the improved discharge belt apparatus of the present invention, generally designated 24' is shown used in conjunction with an angled forming press 20'. The double action, angled press 20' and tooling 30' operate, in a well-known fashion, to form can ends in a similar fashion to upright press 20. Feeder mechanism 22' feeds sheet stock 28' to the tooling 30' and the scrap sheet 34' from which the can ends 32' have been blanked and formed in the press 20; is removed by the sheet ejector mechanism 36'. Furthermore, the formed ends 32' are rapidly discharged by the improved belt discharge apparatus 24' onto the transverse or so called cross conveyors, generally denoted by the reference 38' which in turn feed the end 32' into a cutler station 26' or other following operational or packaging procedure.

As shown in FIG. 14, nose pulley 50' is positioned closely adjacent rear die set 40' so that the discharge belt 48' can quickly grab and discharge the blanked ends away from the press area, along guide tracks formed in the discharge plate 64'. In this embodiment, discharge plate 64' includes an angled portion, generally denoted 118, so that the nose pulley 50' can be placed closely adjacent to the die sets. Discharge plate 64' then slants slightly upwards towards the rear drive pulley 52'. Belt 48' is mounted on nose pulley 50', rear pulleys 52' and pulleys 120–123 so that discharge belt 48' is mounted in close spacial relationship to curved discharge plate 64' to convey the can ends 32' therealong.

The illustrated press 20' is generally shown as having an angle of 35° to the horizontal. However, the overall discharge belt apparatus 24' of the present invention can be used with any press, whether mounted in an upright position or at almost any angle to the horizontal.

From the foregoing, it is believed that those skilled in the art will readily appreciate the unique features and advantages of the present invention over previous types of discharge apparatus and systems for blanked and formed container ends. Further, it is to be understood that while the present invention has been described in relation to a particular preferred embodiment as set forth in the accompanying drawings and as above described, the same nevertheless is susceptible to change, variation and substitution of equivalents without departure from the spirit and scope of this invention. It is therefore intended that the present invention be unrestricted by the foregoing description and drawings, except as may appear in the following appended claims.

I claim:

1. An improved formed end discharge apparatus for discharging blanked and formed container ends from a forming press having end forming tooling, the improvement comprising:

a discharge plate mounted in close proximity to said end forming tooling and extending away from said end forming tooling; and at least one rotating discharge belt mounted in close spatial relationship along said discharge plate for rotation therealong, said rotating discharge belt having a nose end mounted closely adjacent to said forming tooling so as to engage formed ends ejected from said forming tooling, said discharge belt being further adapted to convey said formed ends along said discharge plate to a discharge position after said nose end engages said formed ends.

2. The invention of claim 1, wherein an ejection means is mounted adjacent to said end forming tooling and is operable to eject said formed ends therefrom towards said nose end of said rotating discharge belt so that said nose end can engage said formed ends.

3. The invention of claim 2, wherein said ejection means comprises a first air supply member which provides a blast of air to said formed ends so as to force said formed ends towards said nose end.

4. The invention of claim 1, wherein a guide track is formed along said discharge plate, in alignment with said discharge belt, to receive and guide each said formed ends engaged by said nose end and conveyed by said discharge belt.

5. The invention of claim 4, wherein said guide track is formed with undercut portions for retainably guiding said ends drawn therealong by said rotating discharge belt.

6. The invention of claim 4, wherein said guide track is formed within said discharge plate at an incline thereto.

7. The invention of claim 1, wherein a discharge aperture means is formed in said discharge plate which is in alignment with said discharge belt, said discharge aperture means being operable to receive said formed ends conveyed along said discharge plate by said discharge belt and permit removal of said ends from said discharge plate.

8. The invention of claim 7, wherein an end ejector means is mounted in close proximity to said discharge aperture means such that said end ejector means is operable to assist the removal of said formed end through said discharge aperture means from said discharge plate.

9. The invention of claim 8, wherein said end ejector means comprises a second air supply member which provides a blast of air directed on said formed end to force said formed end through said discharge aperture means.

10. The invention of claim 7, wherein an end collection means is mounted proximate said discharge aperture means and is operable to receive said formed ends removed from said discharge plate through said discharge aperture means.

11. The invention of claim 10, wherein said end collection means comprises a rotating conveyor belt.

12. The invention of claim 7, wherein said rotating conveyor belt is mounted substantially perpendicular to said rotating discharge belt.

13. The invention of claim 1, wherein said ends include ferrous material and said rotating conveyor belt is magnetized so as to readily attract said ends discharge thereon.

14. The invention of claim 1, wherein said end forming tooling is mounted substantially vertically and said discharge belt and said discharge plate extend longitudinally away from said end forming tooling.

15. The invention of claim 1, wherein said end forming tooling is mounted at an angle to the horizontal and said discharge plate is curved such that such nose end is closely adjacent said forming tooling.

16. An improved end discharge apparatus for removing blanked and formed container ends from a forming press having a plurality of end forming tooling, the improvement comprising:

a discharge plate having a plurality of guide track means, said guide track means being respectively mounted in close proximity to each of said end forming toolings and extending away from said end forming toolings; and a plurality of rotating discharge belts, each of said discharge belts mounted in close spatial relationship along each one of said guide track means for rotation therealong, said rotating discharge belts having a nose end mounted closely adjacent to said forming tooling so as to engage formed ends ejected from said forming tooling, said plurality of discharge belts being further adapted to convey said formed ends along said guide track means after said nose ends engage said formed ends.

17. The invention of claim 16, wherein a plurality of ejection means are mounted adjacent to said forming toolings and are operable to eject said formed ends therefrom towards said nose ends of said discharge belts so that said nose ends can engage said formed ends.

18. The invention of claim 17, wherein said plurality of ejection means comprises a first plurality of air supply members which provide blasts of air to said formed ends so as to force said formed ends toward said nose ends.

19. The invention of claim 16, wherein each of said plurality of guide track means is formed along said discharge plate, each said guide track means being in alignment with one of said plurality of discharge belts, to receive and guide each said formed end engaged by each said nose end and conveyed by each said discharge belt.

20. The invention of claim 19, wherein a portion of said plurality of guide track means is comprised of configured guide tracks shaped to confine said formed ends to sliding movement within said configured guide tracks.

21. The invention of claim 20, wherein another portion of said plurality of guide track means is comprised of inclined guide tracks.

22. The invention of claim 21, wherein a plurality of discharge aperture means are formed in said discharge plate, each of said plurality of discharge aperture means being disposed in one of said plurality of guide track means and being operable to receive and allow removal of said formed ends conveyed along each said guide track means by each said discharge belt.

23. The invention of claim 22, wherein a plurality of end ejector means are mounted in close proximity to each of said plurality of discharge aperture means such that each said end ejector means is operable to assist the removal of each said formed end through each said discharge aperture means.

24. The invention of claim 23, wherein each of said plurality of end ejector means comprises a second air supply member which provides a blast of air to said formed ends so as to force said formed ends through each said discharge aperture means.

25. The invention of claim 24, wherein at least one end collection means is mounted proximate to said plurality of discharge aperture means and is operable to receive said formed ends removed by said plurality of discharge aperture means.

26. The invention of claim 25, wherein said end collection means comprises a rotating conveyor belt.

27. The invention of claim 25, and having a first and second set of staggered forming tooling and said nose ends of each said discharge belt are in close proximity to each said forming tooling to engage said formed ends and convey said formed ends along each respective said guide track means.

28. The invention of claim 27, wherein said inclined guide tracks are aligned with the first set of staggered forming tooling and configured guide tracks are aligned with said second set of staggered forming tooling, said plurality of discharge belts operating at different speeds over the configured guide tracks and inclined guide tracks so that the formed ends are conveyed to respective said discharge aperture means substantially simultaneously.

29. The invention of claim 28, wherein said plurality of ejection means substantially simultaneously eject said formed ends from said plurality of staggered forming toolings and said end ejector means substantially simultaneously ejects said formed ends from said discharge aperture means.

30. The invention of claim 29, wherein the operational speed of the said plurality of discharge belts is coordinated with the location of said discharge aperture means so that said formed ends may be substantially simultaneously ejected onto said end collection means.

31. The invention of claim 30, wherein said formed ends are ejected onto said end collection means in substantially the same position as the location of said plurality of discharge aperture means.

32. The invention of claim 16, wherein said end forming tooling is mounted substantially vertically and said discharge belt and said discharge plate extend longitudinally away from said end forming tooling.

33. The invention of claim 16, wherein said end forming tooling is mounted at an angle to the horizontal and said discharge plate is curved such that such nose end is closely adjacent said forming tooling.

* * * * *